United States Patent [19]

Taira et al.

[11] Patent Number: 5,075,665

[45] Date of Patent: Dec. 24, 1991

[54] LAMINATED VARISTOR

[75] Inventors: Hiroaki Taira; Kazutaka Nakamura; Yasunobu Yoneda; Yukio Sakabe; Yutaka Shimahara, all of Kyoto, Japan

[73] Assignee: Murata Manufacturing Co., Ltd., Japan

[21] Appl. No.: 404,838

[22] Filed: Sep. 8, 1989

[30] Foreign Application Priority Data

| | | | |
|---|---|---|---|
| Sep. 8, 1988 | [JP] | Japan | 63-225849 |
| Feb. 21, 1989 | [JP] | Japan | 1-41316 |
| Feb. 21, 1989 | [JP] | Japan | 1-41318 |
| Feb. 21, 1989 | [JP] | Japan | 1-41319 |
| Mar. 31, 1989 | [JP] | Japan | 1-82636 |
| May 16, 1989 | [JP] | Japan | 1-23780 |
| May 24, 1989 | [JP] | Japan | 1-132423 |

[51] Int. Cl.[5] ..... H01C 7/10

[52] U.S. Cl. ..... 338/21; 338/273; 338/274; 338/332

[58] Field of Search ..... 338/20, 21, 64, 273, 338/274, 314, 328, 332

[56] References Cited

U.S. PATENT DOCUMENTS

| | | | |
|---|---|---|---|
| 1,873,362 | 8/1932 | Tanberg | 338/20 |
| 2,361,405 | 10/1944 | Kopple | 338/64 |
| 4,064,475 | 12/1977 | Kouchich et al. | 338/20 |
| 4,069,465 | 1/1978 | Kouchich et al. | 338/20 |
| 4,290,041 | 9/1989 | Utsumi et al. | 338/21 |
| 4,675,644 | 6/1987 | Ott et al. | 338/21 |

*Primary Examiner*—Marvin M. Lateef

*Attorney, Agent, or Firm*—Ostrolenk, Faber, Gerb & Soffen

[57] ABSTRACT

Respective first end portions of first and second internal electrodes are exposed at respective end surfaces of a varistor body, which is in the form of a rectangular parallelepiped. These end surfaces of the varistor body are covered with low resistance parts which include ceramic material in order to prevent the internal electrodes from decomposition. External electrodes are formed on the low resistance parts, so as, to be electrically connected with corresponding ones of the internal electrodes through the low resistance parts.

29 Claims, 8 Drawing Sheets

LAMINATED VARISTOR

BACKGROUND OF THE INVENTION

1. Field of the Invention

The present invention relates to a laminated varistor, and more particularly, it relates to structure in a laminated varistor for preventing decomposition of internal electrodes.

2. Description of the Background Art

A varistor is a resistor element whose resistance value nonlinearly changes in response to applied voltage.

FIG. 17 shows a conventional varistor 1 of a laminated type provided in the form of a rectangular parallelepiped. The laminated varistor 1 shown in FIG. 17 is substantially identical in structure to a laminated varistor which is disclosed in U.S. Pat. No. 4,290,041.

Referring to FIG. 17, the laminated varistor 1 comprises a sintered body 5, which is obtained by alternately stacking ceramic layers 2 and internal electrodes 3 or 4 and integrally sintering the same. First and second external electrodes 8 and 9 of metal are provided on first and second opposite end surfaces 6 and 7 of the sintered body 5. The internal electrodes 3 of a first group have end portions 10 reaching the first end surface 6, to be electrically connected to the first external electrode 8. The internal electrodes 4 of a second group, which are arranged alternately with the internal electrodes 3 of the first group, have end portions 11 reaching the second end surface 7, to be connected to the second external electrode 9.

This laminated varistor 1, and more specifically the sintered body 5, has such structure that the respective end portions 10 and 11 of the internal electrodes 3 and 4 are exposed toward the exterior of the sintered body 5. Therefore, when the sintered body 5 is placed in a humid atmosphere, the exposed portions of the internal electrodes 3 and 4 are easily decomposed. Further, when the external electrodes 8 and 9 are formed by plating, the plating solution easily permeates the sintered body 5 from the exposed portions of the internal electrodes 3 and 4. Consequently, characteristics of the laminated varistor 1 are deteriorated.

SUMMARY OF THE INVENTION

Accordingly, an object of the present invention is to provide a laminated varistor with structure which can circumvent deterioration of varistor characteristics by preventing decomposition of internal electrodes.

Another object of the present invention is to provide a laminated varistor which can improve reliability and maintain quality.

A laminated varistor according to the present invention comprises a varistor part which is formed of a ceramic material which has a varistor function. A plurality of internal electrodes, which are arranged in parallel with each other, are embedded in the varistor part except for portions extended toward the exterior of the varistor part for providing electrical connections. Portions of the varistor part deriving the internal electrodes extend toward the exterior are covered with low resistance parts (layers) which comprise a ceramic material. External terminal means are electrically connected with the internal electrodes through the low resistance parts respectively.

According to one aspect of the present invention, the portions, of the internal electrodes which would otherwise have been exposed from the varistor part can be completely covered with the low resistance parts. Therefore, the internal electrodes can be prevented from decomposition in a humid atmosphere as well as from permeation of a plating solution employed for forming external electrodes. Consequently, deterioration of characteristics in the laminated varistor can be circumvented while reliability and quality of the varistor can be improved.

According to another aspect of the present invention, the internal electrodes are so electrically connected with the low resistance parts that the internal electrodes embedded in the varistor part can be electrically connected to the exterior by providing the external terminal means on outer surfaces of the low resistance parts.

Preferably the varistor part is in the form of a rectangular parallelepiped which has first and second opposite major surfaces, extending in parallel with the internal electrodes, and first and second opposite end surfaces. The plurality of internal electrodes include first and second internal electrodes, which are extended to the first and second end surfaces of the varistor part respectively. The low resistance parts include first and second low resistance parts which cover the first and second end surfaces of the varistor part respectively. Further, the external terminal means are provided by first and second external electrodes which are formed on the first and second low resistance parts respectively.

The internal electrodes may include those of a first group which are extended to the first end surface and those a second group which are extended to the second end surface. The internal electrodes of the first group are alternately arranged with those of the second group. Those of the internal electrodes which are closest to the first and second major surfaces of the varistor part are preferably spaced away from the end surfaces to which they are not intended to extend by a greater distance than are the remaining internal electrodes of the same groups, in order to prevent the low resistance parts from approaching or coming into contact with the internal electrodes at undesired locations thereby to prevent the varistor from the flowing of any undesired leakage current.

The low resistance parts may be arranged so as to partially form at least one of the major surfaces of the varistor part. In this case, a plurality of internal electrodes may be connected with the same low resistance part and with each other through viahole connecting parts which are defined in the varistor part.

The varistor part is preferably formed by the firing of a ceramic material which has a varistor function, and the low resistance parts are formed of a ceramic material which is semiconductorized (made semiconductive) by firing. In this case, the varistor part and the low resistance parts may be cofired to be integrated with each other, or a raw ceramic material for forming the low resistance parts may be applied to a fired varistor part, and then fired. In either case, the raw ceramic material for forming the low resistance parts is prepared in the form of paste or sheets containing the ceramic material, and applied to prescribed regions of the varistor part. In the low resistance parts thus formed the, composition of the ceramic material contained therein and the thickness thereof can be so correctly controlled so as to prevent the varistor from undergoing any variation of its characteristics caused by any change in the state of connection between the low resistance parts and the internal electrodes. The raw ceramic material for forming the low resistance parts preferably contains a ceramic material which is identical in composition to that forming the varistor part and at least one element selected from the group consisting of Al, Ga, Gd, Zn and Y.

As just mentioned, the varistor part and the low resistance parts may be comprised by an integrally fired common ceramic body; thus, the low resistance parts are obtained by partially lowering the resistance of this ceramic body. In this case, the low resistance parts are formed on the ceramic body by applying paste containing at least one element selected from the group of Al, Ga, Gd, Zn and Y to parts of the ceramic body and performing heat treatment. Alternatively, the low resistance parts can be also formed on the ceramic body by applying a reducing solution to parts of the ceramic body. The reducing solution is preferably prepared from an organic borane compound solution.

These and other objects, features, aspects and advantages of the present invention will become more apparent from the following detailed description of the present invention when taken in conjunction with the accompanying drawings.

DESCRIPTION OF THE PREFERRED EMBODIMENTS

FIGS. 1-6

Figure 1:
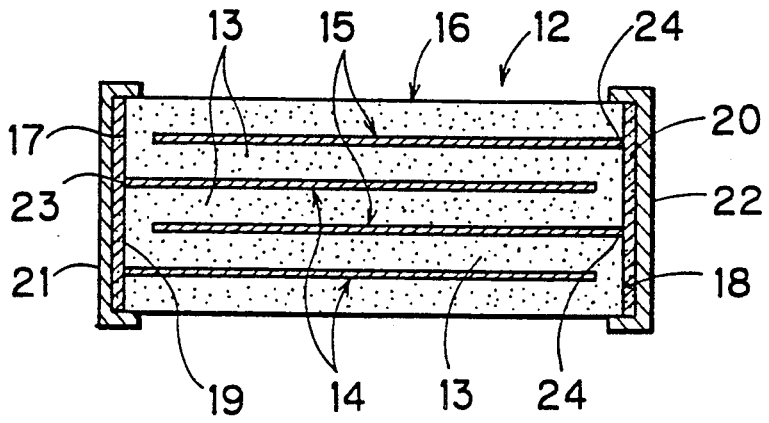
FIG. 1, illustrating a laminated varistor according to a first embodiment of the present invention, is a sectional view taken along the line I—I in FIG. 2.
Figure 2:
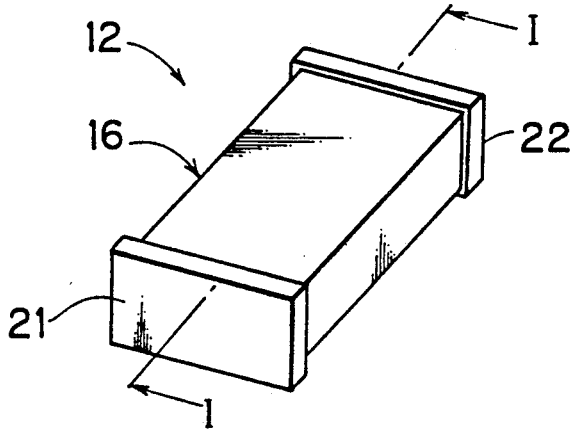
FIG. 2 is a perspective view illustrating the appearance of the laminated varistor shown in FIG. 1.

Referring to a first embodiment of the invention shown in FIGS. 1 to 4, a laminated varistor 12 provided in the overall form of a rectangular parallelepiped. It comprises a sintered body (varistor part) 16, which is obtained by alternately stacking ceramic layers 13 which have a varistor function and internal electrodes 14 or 15 made of platinum, for example, and integrally firing the same. The sintered body 16 has first and second opposite end surfaces 17 and 18. Film-type first and second low resistance parts 19 and 20 are provided on the first and second end surfaces 17 and 18 respectively. First and second external electrodes 21 and 22, which are formed of silver, palladium or an alloy thereof, are provided on the first and second low resistance parts 19 and 20 respectively.

The internal electrodes 14 of a first group are exposed only at first end portions 23 thereof from the sintered body, i.e., varistor part 16, and such exposed portions are positioned at the first end surface 17 of the varistor part 16. The first end surface 17 is covered with the first low resistance part 19 as hereinabove described, thereby to prevent the internal electrodes 14 from permeation of moisture or a plating solution. Further, since the low resistance part 19 is in contact with the internal electrodes 14, the first external electrode 21 is electrically connected with the internal electrodes 14 through the low resistance part 19. Similarly, the internal electrodes 15 of a second group are exposed to the exterior of the second end surface 18 of the varistor part 16 only at first end portions 24 thereof. The second end surface 18 is covered with the second low resistance part 20, thereby to prevent the internal electrodes 15 from permeation of moisture or the plating solution and to electrically connect the second external electrodes 22 with the internal electrodes 15 through the low resistance part 20.

The low resistance parts 19 and 20 are formed by applying paste mainly composed of ceramic powder having the same composition as the ceramic layers 13, plus aluminum, for example, to the end surfaces 17 and 18 of the sintered body, i.e., varistor part 16, and firing the same.

A method of fabricating the laminated varistor 12 is now described in more concrete terms.

(1) 10 percent by weight of glass powder formed of $B_2O_3$, $SiO_2$, PbO and ZnO is added to a ceramic material prepared by mixing 95.0 mole percent of ZnO, 1.0 mole percent of CoO, 1.0 mole percent of MnO, 2.0 mole percent of $Sb_2O_3$ and 1.0 mole percent of $Cr_2O_3$ and mixed with each other with addition of an organic binder. A ceramic green sheet is obtained by applying the doctor blade coater to the mixture thus obtained. Then, this green sheet is cut into rectangles of prescribed dimensions, thereby to obtain the plurality of ceramic layers 13.

(2) Then, paste prepared by mixing platinum with a vehicle is applied to upper surfaces of the ceramic layers 13, to form the internal electrodes 14 and 15. At this time, the first end portions 23 and 24 of the internal electrodes 14 and 15 are made to reach respective edges of the ceramic layers 13 while second end portions of the internal electrodes 14 and 15 are made not to reach corresponding edges of the ceramic layers 13.

Figure 3:
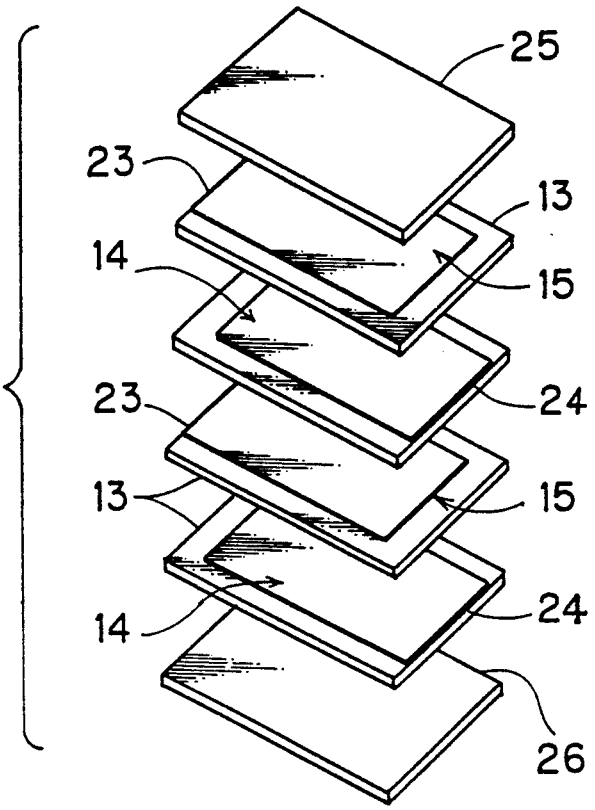
FIG. 3 is an exploded perspective view illustrating process for manufacturing the sintered body shown in FIG. 1.

(3) Then, the ceramic layers 13 are successively stacked so that the ceramic layers 13 and the internal electrodes 14 or 15 alternately overlap with each other and the internal electrodes 14 and 15 of the first and second groups are alternately arranged, as shown in FIG. 3. Further, ceramic sheets 25 and 26, which are provided with no internal electrodes, are placed on upper and lower surfaces of the laminate and pressurized in the direction of lamination.

(4) Then, the laminate obtained at the step (3) is fired in the air at a temperature of 1200° C. for three hours, thereby to obtain the sintered body 16.

Figure 4:
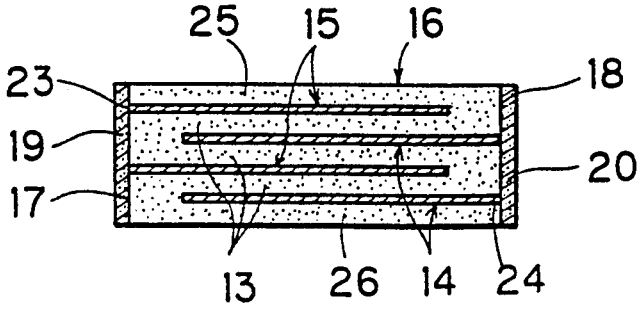
FIG. 4 is a sectional view showing an intermediate stage in which the sintered body is provided with low resistance parts.

(5) Then, first and second low resistance parts 19 and 20 are formed to cover the first and second end surfaces 17 and 18 of the sintered body 16 respectively, as shown in FIG. 4. The low resistance parts 19 and 20 are formed by applying paste obtained by adding 5 percent by weight of aluminum powder to ceramic powder having the same composition as the ceramic layers 13 prepared at the above step (1) and mixing the same with a vehicle to be 50 μm in thickness and firing the same in the air at a temperature of 1100° C. In this firing step, $Al_2O_3$ is dissolved in ZnO by reaction between ZnO and aluminum, whereby a semiconductor material whose resistance value is lowered is obtained. Consequently, the low resistance parts 19 and 20 are supplied with prescribed conductivity.

The raw ceramic material for forming the low resistance parts 19 and 20 may contain metal such as Ga, Gd or Y, in place of the aforementioned aluminum. Further, the low resistance parts 19 and 20 may be formed of a low resistance ceramic material such as $RuO_2$, in place of ZnO. If the sintered body 16 is of a ceramic material containing ZnO, the raw ceramic material for forming the low resistance parts 19 and 20 may contain metal zinc and zinc oxide.

As an alternative to the above method of applying paste to form the low resistance parts 19 and 20, or in addition thereto, the low resistance parts 19 and 20 can also be formed by of adhering green sheets, which are substantially identical in composition to the aforementioned paste, onto the first and second end surfaces 17 and 18.

(6) Then, masks are applied, to portions of the sintered body 16 obtained in the above step (5) except for both end portions and the low resistance parts 19 and 20, and then electrolytic plating with nickel or copper, for example, is performed to form the external electrodes 21 and 22 on the outer surfaces of the low resistance parts 19 and 20 as shown in FIG. 1. The external electrodes 21 and 22 may alternatively be formed by applying paste obtained by adding palladium to silver onto the outer surfaces of the low resistance parts 19 and 20 respectively and baking the same. Further, each of the external electrodes 21 and 22 may have a multilayer structure comprising a plurality of metal layers.

Thus, the laminated varistor 12 is obtained.

The raw ceramic material, employed at the above step (5), for forming the low resistance parts 19 and 20, may be applied to the unfired laminate obtained at the step (3), and then to the varistor part 16, and the low resistance parts 19 and 20 may be cofired. In this case, the same firing conditions as those of the above step (4) may be employed.

In the laminated varistor 12, the low resistance parts 19 and 20 are formed to cover the end portions 23 and 24 of the internal electrodes 14 and 15 exposed on the end surfaces 17 and 18 of the sintered body, i.e., varistor part 16. Therefore, the internal electrodes 14 and 15 will not be decomposed even if the varistor 12 is used in a humid atmosphere, and also no plating solution will permeate through the internal electrodes 14 and 15 even if the sintered body, i.e., varistor part 16 is dipped in a plating solution. Therefore, the varistor 12 can be prevented from deterioration of characteristics originally provided therein.

In this varistor 12, further, the internal electrodes 14 and 15 are respectively connected with the external electrodes 21 and 22 through the low resistance parts 19 and 20 which are formed to cover the respective end portions 23 and 24 exposed from the varistor part 16. Thus, the internal electrodes 14 and 15, which are completely contained within the varistor part 16 and the low resistance parts 19 and 20 formed of ceramic materials respectively, can be electrically connected with the exterior.

The low resistance parts 19 and 20 can be easily formed by carrying out the above step (5). As for the low resistance parts 19 and 20, further the, composition of the, ceramic material contained therein, the amount of added metal such as aluminum, and the thickness thereof, can be correctly controlled, thereby reducing variations in electrical properties among the varistors 12 thus obtained.

Figure 5:
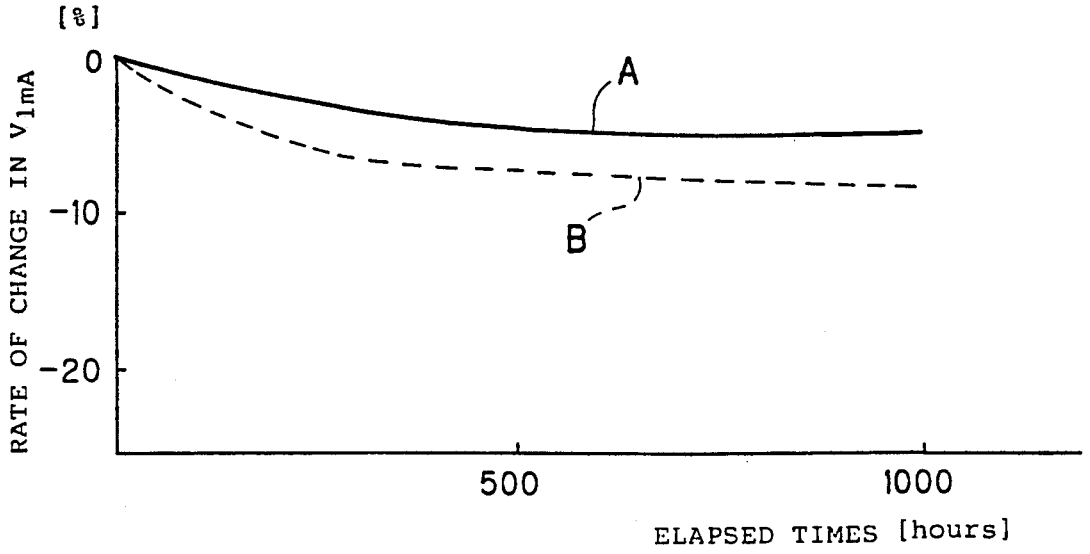
FIGS. 5 and 6 illustrate percentage changes in rates of threshold voltages in the laminated varistor shown in FIG. 1, compared with a reference example.
Figure 6:
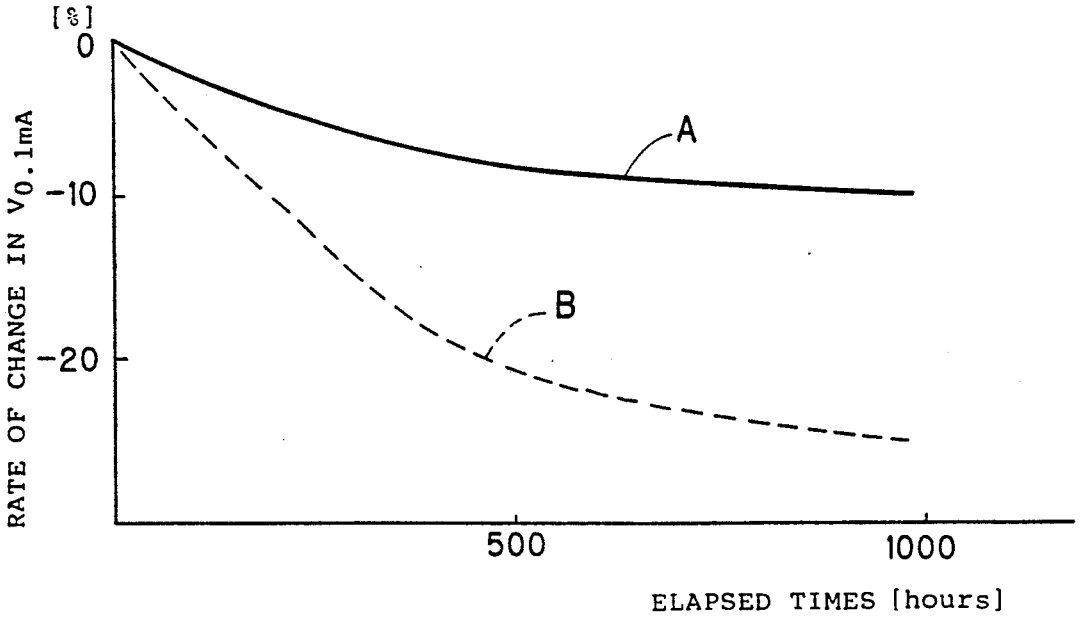

FIGS. 5 and 6 illustrate the results of a humidity test made for confirming the effect of this embodiment. In this test, the laminated varistor 12 shown in FIG. 1 was left in an atmosphere having a temperature of 60° C. and relative humidity of 90 % for 1000 hours and thereafter placed back into an ordinary atmosphere, to examine the rates of change over time of $V_{1mA}$ and $V_{0.1mA}$. $V_{1mA}$ and $V_{0.1mA}$, called threshold voltages, represent the voltage values observed when currents flowing in the varistor were 1 mA and 0.1 mA respectively. A similar test was made on a varistor which was identical in structure to the varistor 12 except that no low resistance parts 19 and 20 as shown in FIG. 1 were provided, for the purpose of reference.

FIG. 5 shows the relation between the percentage of change in $V_{1mA}$ and the elapsed time, and FIG. 6 shows the relation between the percentage change in $V_{0.1mA}$ and the elapsed times time. In these figures, curves A (solid lines) show the relation for the embodiment and curves B (broken lines) show the relation for the reference example.

Although no significant difference was observed between the samples A and B as to the rates of change in $V_{1mA}$, as significant improvement was seen for $V_{0.1mA}$. The sample B exhibited the a change of −25 % while the sample A exhibited the a change of only −9 % after lapse of 1000 hours, as understood from FIGS. 5 and 6. Thus, it is understood that moisture resistance was improved in the sample A.

While the external electrodes were formed by baking metal paste in both of the samples subjected to the aforementioned tests, no deterioration of characteristics was seen in another sample of the present invention in which the external electrodes were formed by plating.

FIG. 7-9

Figure 7:
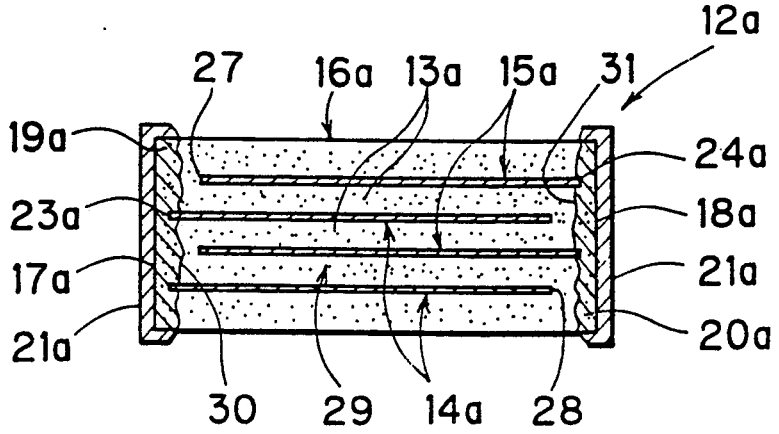
FIG. 7 is a sectional view showing a laminated varistor according to a second embodiment of the present invention.
Figure 8:
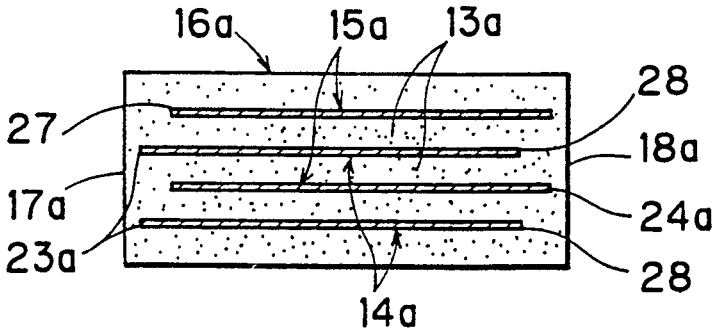
FIG. 8 is a sectional view showing the sintered body of FIG. 7 not yet provided with low resistance parts.

With reference to FIGS. 7 and 8, a second embodiment of the present invention is now described.

A laminated varistor **12*a* and a sintered body 16*a* shown in FIG. 7 and/or FIG. 8 comprise elements which are substantially identical to those included in the laminated varistor 12 and the sintered body 16** shown in FIG. 1. Referring to FIGS. 7 and 8, therefore, elements or parts corresponding to those shown in FIG. 1 are indicated by the same reference numerals as those in FIG. 1 with subscripts "a", to omit redundant description.

In order to obtain the laminated varistor 12a, the sintered body 16a shown in FIG. 8 is first prepared. This sintered body 16a is formed by alternately stacking ceramic layers 13a of a ceramic material having a varistor function and internal electrodes 14a or 15a. The internal electrodes 14a and 15a are completely embedded within the sintered body 16a. The internal electrodes 14a of a first group have end portions 24a which are relatively closer to a first end surface 17a, than are the corresponding end portions 27 of the internal electrodes 15a of a second group. Similarly, the internal electrodes 15a of the second group have end portions 24a which are closer to a second end surface 18a than the corresponding end portions 28 of the internal electrodes 14a of the first group.

As shown in FIG. 7, first and second low resistance parts 19a and 20a are provided on respective end portions of the sintered body 16a. The low resistance parts 19a and 20a are formed by semiconductorizing the end portions of the sintered body 16a shown in FIG. 8. Thus, the first and second low resistance parts 19a and 20a and the varistor part 29 are all comprised in the sintered body 16a, which is a common ceramic body, while first and second end surfaces 30 and 31 of the varistor part 29 are defined by interfaces between the respective ones of the first and second low resistance parts 19a and 20a and the varistor part 29. The internal electrodes 14a of the first group are electrically connected to the first end surface 30, since the respective end portions 23a are positioned in the first low resistance part 19a. On the other hand, the internal electrodes 15a of the second group are electrically connected to the second end surface 31, since the respective end portions 24a are positioned in the second low resistance part 20a. Therefore, the internal electrodes 14a of the first group are electrically connected to a first external electrode 21a through the first low resistance part 19a, while the internal electrodes 15a of the second group are electrically connected to a second external electrode 22a through the second low resistance part 20a.

A method of fabricating the laminated varistor 12a shown in FIG. 7 is now described.

(1) The step (1) in the aforementioned first embodiment is carried out to prepare the ceramic layers 13a.

(2) The step (2) in the aforementioned first embodiment is carried out to form the internal electrodes 14a or 15a on the ceramic layers 13a.

(3) The step (3) in the aforementioned first embodiment is carried out to obtain a laminate for forming the sintered body 16a.

(4) The step (4) in the aforementioned first embodiment is carried out to obtain the sintered body 16a shown in FIG. 8.

(5) Paste mainly composed of Al is applied onto the first and second end surfaces 17a and 18a of the sintered body 16a and heated at 1000° C. for one hour. Thus, $Al_2O_3$ is dissolved in ZnO on both end portions of the sintered body 16a, whereby the first and second low resistance parts 19a and 20a are formed through semiconductorization by lowering the resistance values of the end portions.

The aforementioned paste may contain metal such as Ga, Gd, Zn or Y in place of Al.

(6) The step (6) in the aforementioned first embodiment is carried out to form the external electrodes 21a and 22a, thereby to obtain the laminated varistor 12a.

Characteristics similar to those shown in FIGS. 5 and 6 can be attained also by the laminated varistor 12a.

The above described paste containing aluminum may be applied onto respective end surfaces of the unfired laminate obtained in the above step (3), and then step (4) may be carried out. The first and second low resistance parts 19a and 20a can similarly be formed on the respective end portions of the sintered body 16a also by this method.

Further, it is also possible to form the low resistance parts 19a and 20a as shown in FIG. 7, by reducing both end portions of the sintered body 16a shown in FIG. 8 by means of reducing solution. For example, the low resistance parts 19a and 20a can be formed on the sintered body 16a by dipping the end portions of the sintered body 16a in the reducing solution or bringing the former into contact wit the latter by some other method. The reducing solution is prepared from an organic borane compound solution such as a saturated solution of dimethylamine borane, for example.

In more concrete terms, the first and second end surfaces 17a and 18a of the sintered body 16a are brought into contact with paper infiltrated with a saturated solution of dimethylamine borane, and retained in this state at a temperature of 60° C. for five hours. Thus, the end portions of the sintered body 16a are reduced so as to have low resistance values, whereby to define the first and second low resistance parts 19a and 20a, as shown in FIG. 7. After such reduction processing, the sintered body 16a is washed with water to remove the reducing solution remaining on the surface of the sintered body 16a, thereby to circumvent any inconvenience that may be caused by the reducing solution in the succeeding steps of fabricating the varistor 12a.

One problem with the laminated varistor 12a shown in FIG. 7, for example, is that it may easily have leakage or shorting caused by problems in fabrication, and shorting may be. This is now described with reference to FIG. 9.

Referring to FIB. 9, when the first and second low resistance parts 19a and 20a are to be formed by partially lowering the resistance of a sintered body 16a, such resistance lowering process can have an excessive effect in the vicinity of first and second major surfaces 32 and 33 of the sintered body 16a which extend in parallel with the internal electrodes 14a and 15a. Therefore, the first and second low resistance parts 19a and 20a can inwardly project in the vicinity of the major surfaces 32 and 33, as shown in a somewhat exaggerated manner in FIG. 9. Consequently, internal electrodes 14a-1 and 15a-1, which are closest to the first and second major surfaces 32 and 33, may undesirably approach or come into contact with the second and first low resistance parts 20a and 19a respectively. In other words, an end portion 28 of the internal electrodes 14a-1, which must not be electrically connected with the second low resistance part 20a, inevitably approaches or comes into contact with the second low resistance part 20a. Similarly an end portion 27 of the internal electrode 15a-1, which must not be electrically connected with the first low resistance part 19a, of the internal electrode 15a-1 inevitably approaches or comes into contact with the first low resistance part 19a. This is considered to lead to the risk of the leakage current or shorting.

FIG. 10

Figure 9:
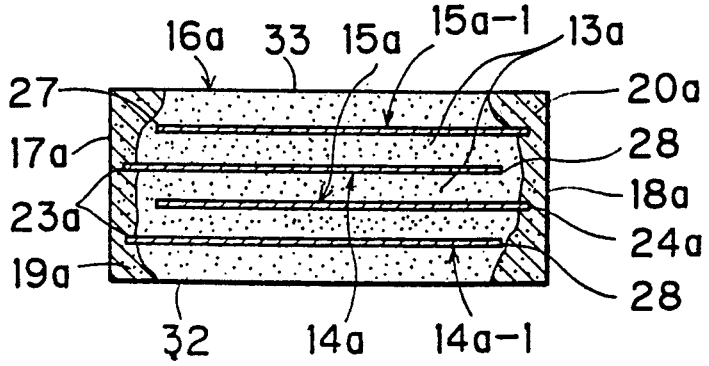
FIG. 9 is a sectional view of, the sintered body illustrating problems that may be caused in the embodiment shown in FIGS. 7 and 8.
Figure 10:
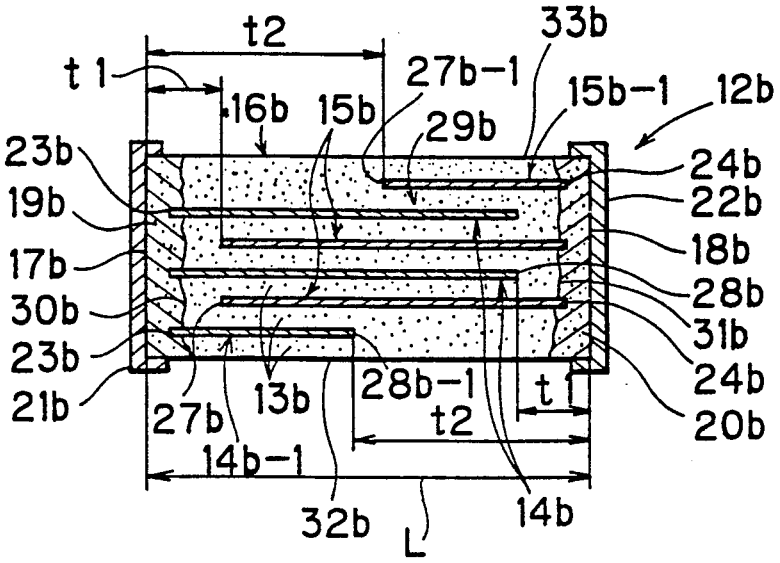
FIG. 10 is a sectional view, showing a laminated varistor according to a third embodiment of the present invention.

FIG. 10 shows a third embodiment of a laminated varistor 12*b*, which can solve the aforementioned problems. Referring to FIG. 10, elements or parts corresponding to those shown in FIG. 1, 7 or 9 are indicated by the same reference numerals with subscripts "b", to omit redundant description.

Referring to FIG. 10, the laminated varistor 12*b* comprises a sintered body 16*b* obtained by alternately stacking ceramic layers 13*b* of a ceramic material which has a varistor function and internal electrodes 14*b* or 15*b* and firing the same. First and second external electrodes 21*b* and 22*b* are formed on first and second end surfaces 17*b* and 18*b* of the sintered body 16*b* respectively. Further, first and second low resistance parts 19*b* and 20*b* are formed on respective end portions of the sintered body 16*b*. Thus, the remaining portion of the sintered body 16*b* defines a varistor part 29*b*. The varistor part 29*b* is provided with first and second end surfaces 30*b* and 31*b* in respective interfaces with the first and second low resistance parts 19*b* and 20*b*.

The internal electrodes 14*b* of a first group are electrically connected with the first low resistance part 19*b* in respective end portions 23*b* thereof. On the other hand, the internal electrodes 15*b* of a second group are electrically connected with the second low resistance part 20*b* at respective end portions 24*b* thereof.

With one specific exception, a second end portion 28*b* of each internal electrode 14*b* of the first group is separated from the second end surface 18*b* by a distance tl. Similarly, a second end portion 27*b* of each internal electrode 15*b* of the second group is separated from the first and surface 17*b* by a distance tl, with one specific exception. These specific exceptions will now be described.

A second end portion 28*b*-1 of a specific one of the internal electrodes 14*b* of the first group, namely the internal electrode 14*b*-1 which is closest to the first major surface 32*b* , is separated from the first end surface 18*b* by a distance t2. Similarly, a second end portion 27*b*-1 of a specific one of the internal electrodes 15*b* of the second group, i.e., internal electrode 15*b*-1 which is closest to the second major surface 33*b*, is separated from the first end surface 17*b* by a space t2. The space t2 is larger than the distance t1. Preferably the internal electrodes 14*b*-1 and 15*b*-1, which are closest to the major surfaces 32*b* and 33*b*, are shorter than half the length L of the sintered body 16*b*.

FIG. 11

Figure 11:
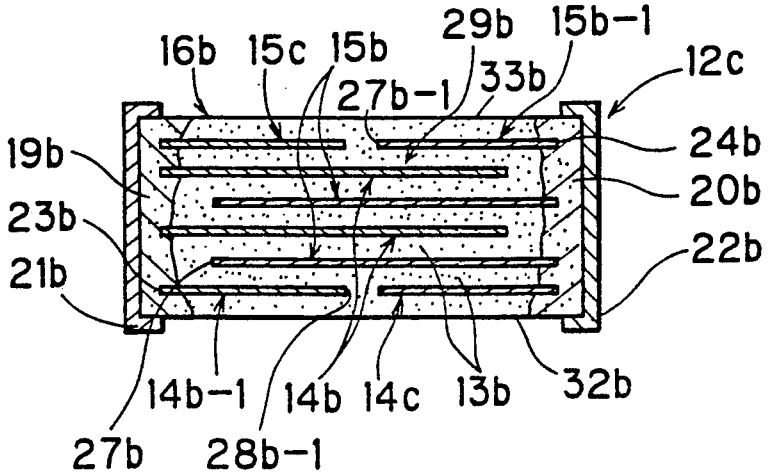
FIG. 11 is a sectional view showing a laminated varistor according to a fourth embodiment of the present invention.

FIG. 11 shows a further embodiment of a laminated varistor 12*c*, which is obtained by slightly modifying the laminated varistor 12*b* shown in FIG. 10. The laminated varistor 12*b* shown in FIG. 11 includes a large number of elements which are common with those of the laminated varistor 12*b* shown in FIG. 10. Referring to FIG. 11, therefore, elements or parts corresponding to those shown in FIG. 10 are indicated by the same reference numerals, to omit redundant description.

The laminated varistor 12*c* shown in FIG. 11 is characterized in that a dummy electrode 14*c* is formed to align with the internal electrode 14*b*-1 and a dummy electrode 15*c* is formed to align with the internal electrode 15*b*-1. These dummy electrodes 14*c* and 15*c* define gaps between themselves and the internal electrodes 14*b*-1 and 15*b*-1 respectively.

The dummy electrodes 14*c* and 15*c*, which have no particularly remarkable electrical functions in the laminated varistor 12*c*, are printed and formed on the same ceramic layers 13*b* as the respective ones of the internal electrodes 14*b*-1 and 15*b*-1, to facilitate the operation wherein the internal electrodes 14*b*-1 and 15*b*-1 are printed and to avoid any inbalance in the thickness of the ceramic layers caused by the internal electrodes 14*b*-1 and 15*b*-1, thereby to further facilitate the operation of stacking the ceramic layers 13*b*.

FIGS. 12-15

With reference to FIGS. 12 to 15, a fifth embodiment of the present invention is now described.

Figure 12:
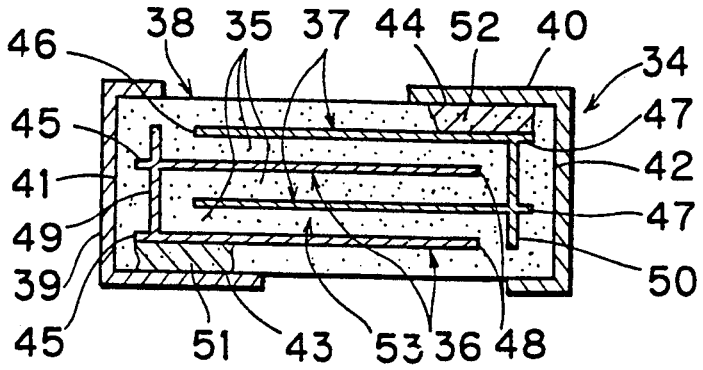
FIG. 12, illustrating a laminated varistor according to a fifth embodiment of the present invention, is a sectional view taken along the line XII—XII in FIG. 14.
Figure 13:
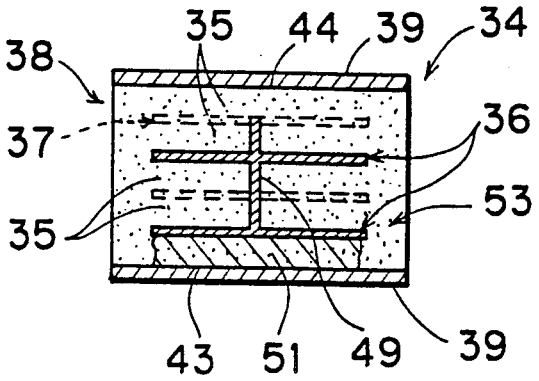
FIG. 13, illustrating the laminated varistor shown in FIG. 12, is a sectional view taken along the line XIII—XIII in FIG. 14.
Figure 14:
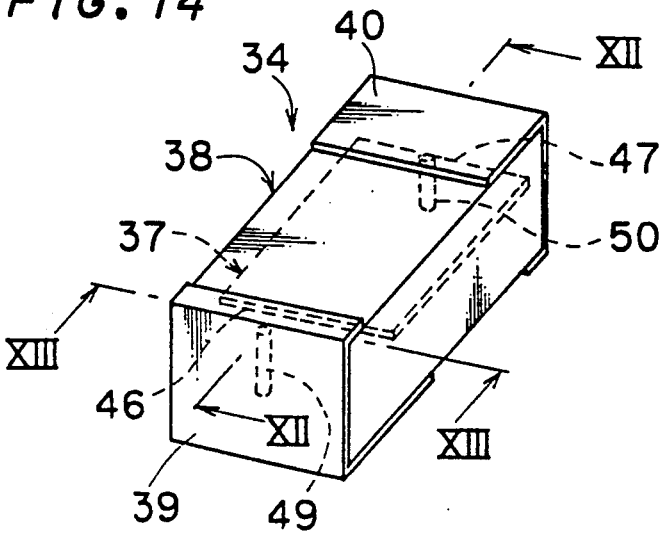
FIG. 14 is a perspective view illustrating the appearance of the laminated varistor shown in FIG. 12.

A laminated varistor 34 shown in FIGS. 12 to 14 comprises a sintered body 38, which is obtained by alternately stacking ceramic layers 35 of a ceramic material which functions as a varistor and internal electrodes 36 or 37 and firing the same. First and second external electrodes 39 and 40 are formed on outer surfaces of the sintered body 38. The first external electrode 39 is mainly formed over a first end surface 41 and a first major surface 43 of the sintered body 38, while the second external electrode 40 is mainly formed over a second end surface 42 and a second major surface 44 of the sintered body 38.

The internal electrodes 36 and 37 are completely embedded within the sintered body 38. First end portions 45 of the internal electrodes 36 of a first group are closer to the first end surface 41, then the first end portions 46 of the internal electrodes 37 of a second group. On the other hand, second end portions 47 of the internal electrodes 37 of the second group are closer to the second end surface 42, than are the second end portions 48 of the internal electrodes 36 of the first group. The respective first end portions 45 of the internal electrodes 36 of the first group are electrically connected with each other through a viahole connecting part 49 extending within the sintered body 38 along the direction of lamination. On the other hand, the respective first end portions 47 of the internal electrodes 37 of the second group are electrically connected with each other by a second viahole connecting part 50 extending within the sintered body 38 along the direction of lamination.

A first low resistance part 51 is formed in a region along the first major surface 43 of the sintered body 38 and between the first external electrode 39 and an internal electrode 36 which is closest to the same. A second low resistance part 52 is formed in a region along the second major surface 44 of the sintered body 38 and between the second external electrode 40 and an internal electrode 37 which is closest to the same. Thus, a major portion of the sintered body 38, with the exception of first and second low resistance parts 51 and 52, defines a varistor part 53. In this embodiment, the first low resistance part 51 is provided to partially form the first major surface 43 of the varistor part 53, while the second low resistance part 52 is provided to partially form the second major surface 44 of the varistor part 53.

In the laminated varistor 34 thus obtained, the internal electrodes 36 of the first group are electrically connected with the first external electrode 39 through the first viahole connecting part 49 and the first low resistance part 51. On the other hand, the internal electrodes 37 of the second group are electrically connected with the second external electrode 40 through the second viahole connecting part 50 and the second low resistance part 52.

The laminated varistor 34 can be fabricated by application of a method which is substantially similar to that for the laminated varistor 12*a* shown in FIG. 7, for example. However the fabricating method for the laminated varistor 34 is different from that for the laminated varistor 12*a* shown in FIG. 7 in that the viahole connecting parts 49 and 50 are to be formed, and in the positions where the low resistance parts 51 and 52 are to be formed.

Figure 15:
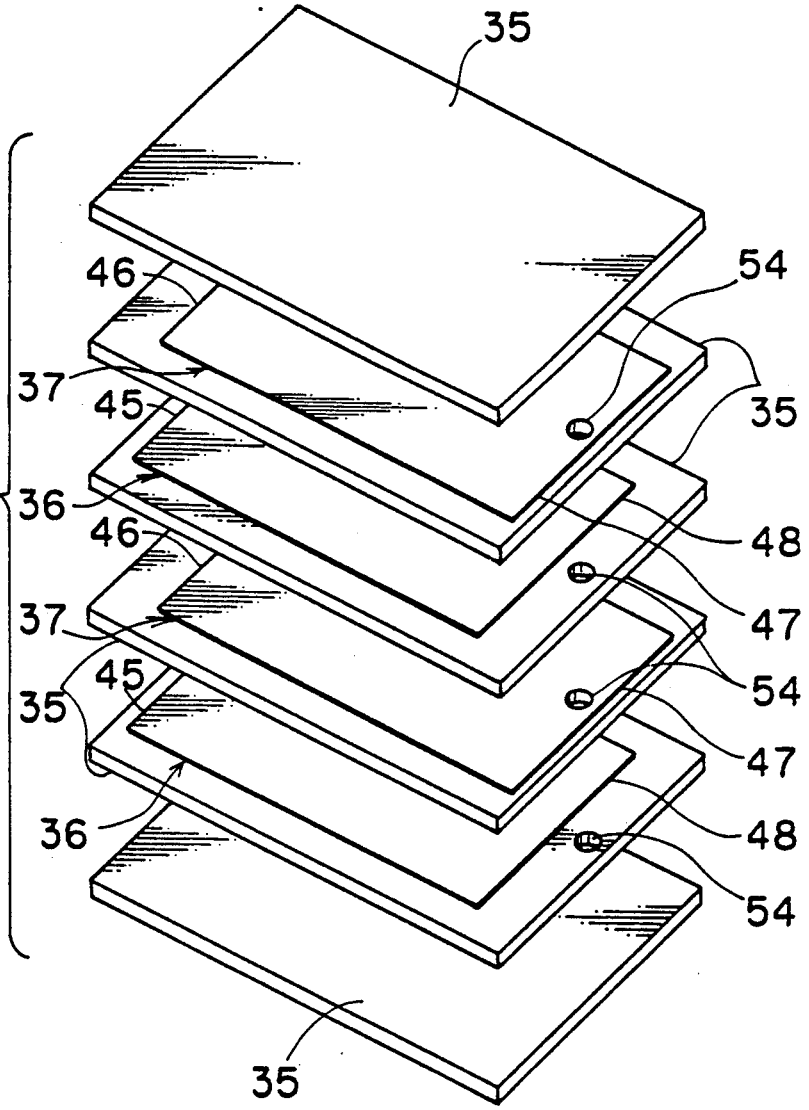
FIG. 15 is an exploded perspective view illustrating the sintered body shown in FIG. 12.

To provide the viahole connecting parts 49 and 50, through holes 54 may be formed in prescribed positions of the ceramic layers 35 as shown in FIG. 15, and then filled with metal parts which is identical to that for forming the internal electrodes 36 and 37. The through holes 54 may all be formed at the same time, by stacking only the ceramic layers 35 to be provided with the through holes 54.

As to the locations of the low resistance parts 51 and 52, the laminated varistor 34 is merely different from the laminated varistor 12*a* shown in FIG. 7 in that the process for lowering the resistance of the ceramic material is performed toward the first and second major surfaces 43 and 44. The process itself may be performed through various methods, similarly to the case of the laminated varistor 12*a*.

According to the embodiment shown in FIGS. 12 to 15, the degree of progress of the resistance lowering process for forming the low resistance parts 51 and 52 is regulated by the internal electrodes 36 or 37. Therefore, the inconvenience described above with reference to FIG. 9 not caused and there is no need to strictly control the processing conditions in the resistance lowering process in order to circumvent such inconvenience.

FIG. 16

Figure 16:
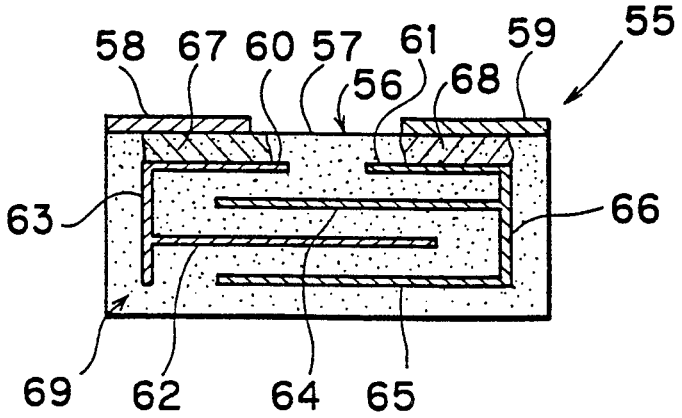
FIG. 16 is a sectional view showing a laminated varistor according to a sixth embodiment of the present invention.
Figure 17:
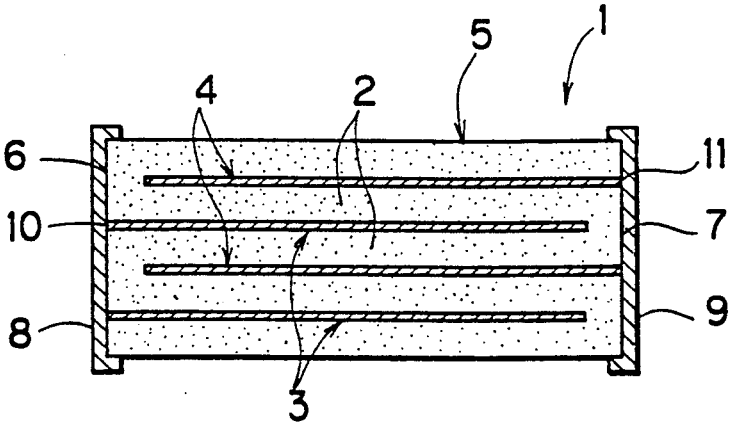
FIG. 17 PRIOR ART
FIG. 17 is a sectional view showing a conventional laminated varistor.

FIG. 16 shows a sixth embodiment of the present invention.

A laminated varistor 55 shown in FIG. 16 is basically formed by the same technique as that for the aforementioned laminated varistor 34. In this laminated varistor 55, first and second external electrodes 58 and 59 are formed on respective end portions of a first major surface 57 of a sintered body 56, thereby to enable application of wire bonding.

The sintered body 56 is provided, in a its relatively upper portion as shown in FIG. 16, with internal electrodes 60 and 61, which are flush with each other. The internal electrode 60 is connected with an internal electrode 62, which is located under the same, through a viahole connecting part 63. On the other hand, the internal electrode 61 is connected with internal electrodes 64 and 65, which are located under the same, through a viahole connecting part 66. The internal electrode 62 is located between the internal electrodes 64 and 65.

A first low resistance part 67 is formed between the first external electrode 58 and the internal electrode 60. On the other hand, a second low resistance part 68 is formed between the second external electrode 59 and the internal electrode 61. Thus, the sintered body 56 defines a varistor part 69, except for portions occupied by the low resistance parts 67 and 68.

Although a plurality of pairs of internal electrodes are provided in one laminated varistor in each of the above described embodiments, the present invention is also applicable to a laminated varistor which is provided with only one pair of internal electrodes. As to the laminated varistor shown in FIG. 12, for example, the central pair of internal electrodes 36 and 37 and the viahole connecting parts 49 and 50 may be removed so that the laminated varistor comprises only one pair of internal electrodes.

Although several embodiments of the present invention have been described and illustrated in detail, it is clearly understood that the same is by way of illustration and example only and is not to be taken by way of limitation, the scope of the present invention being limited only by the terms of the appended claims.

What is claimed is:

1. A laminated varistor comprising:

a varistor part formed of a ceramic material which has a varistor function;

a plurality of internal electrodes arranged in parallel with each other, said internal electrodes being embedded within said varistor part, and respective connection portions thereof being electrically exposed to the exterior of said varistor part;

at least two low resistance parts formed of a ceramic material, respective ones of said low resistance parts being electrically connected to said connection portion of said internal electrodes and protecting said internal electrode from external moisture; and at least two external terminal means on said varistor part which are electrically connected respectively to said low resistance parts, said connection portions of said internal electrodes being electrically exposed to the exterior through said low resistance parts.

2. A laminated varistor in accordance with claim 1, wherein said varistor part has first and second opposite end surfaces;

said plurality of internal electrodes include first and second internal electrodes, said first and second internal electrodes being exposed at said first and second end surfaces respectively;

said at least two low resistance parts include first and second low resistance parts covering said first and second end surfaces respectively; and said at least two external terminal means include first and second external electrodes formed on said first and second low resistance parts respectively and thereby being electrically connected to said first and second internal electrodes respectively.

3. A laminated varistor in accordance with claim 1, wherein said varistor part has first and second opposite major surfaces, extending in parallel with said internal electrodes, and first and second opposite end surface; said plurality of internal electrodes include internal electrodes of a first group and internal electrodes of a second group, said internal electrodes of said first and second groups being alternately arranged and electrically connected to said first and second end surfaces respectively; and said at least two low resistance parts include portions of said varistor part having lowered resistance at said first and second end surfaces respectively.

4. A laminated varistor in accordance with claim 3, wherein a predetermined one of said internal electrodes of said first group, which is adjacent to one of said major surfaces, is separated from said second end surface by a greater distance than the other internal electrodes of said first group; and a predetermined one of said internal electrodes of said second group, which is adjacent to the other of said major surface, is separated from said first end surface by a greater distance than the other internal electrodes of said second group.

5. A laminated varistor in accordance with claim 4, wherein said varistor part has an overall length, and the lengths of said predetermined ones of said internal electrodes of both said first and second groups are less than half the overall length of the varistor part.

6. A laminated varistor in accordance with claim 4, further comprising respective dummy electrodes embedded in said varistor part and substantially coplanar with said predetermined ones of said internal electrodes.

7. A laminated varistor in accordance with claim 1, wherein said varistor part has first and second opposite major surfaces extending in parallel with said internal electrodes; said internal electrodes include first and second internal electrodes; and said first low resistance part is in contact with said first internal electrode and forms a part of said first major surface of said varistor part and said second low resistance part is in contact with said second internal electrode and forms a part of said second major surface of said varistor part.

8. A laminated varistor in accordance with claim 7, wherein said internal electrodes include internal electrodes of a first group, including said first internal electrode, and internal electrodes of a second group, including said second internal electrode, said internal electrodes of said first and second groups being alternately arranged; said laminated varistor further comprising a first viahole connecting part defined in said varistor part which electrically connects said internal electrodes of said first group with each other and a second viahole connecting part defined in said varistor part which electrically connects said internal electrodes of said second group with each other.

9. A laminated varistor in accordance with claim 7, wherein said varistor part also has first and second opposite end surfaces, said low resistance parts being spaced away from said end surfaces of said varistor part.

10. A laminated varistor in accordance with claim 1, wherein said varistor part has a major surface extending in parallel with said internal electrodes; said internal electrodes include internal electrodes of a first group and internal electrodes of a second group, said internal electrodes of said first and second groups being alternately arranged; and said first low resistance part is in contact with one of said internal electrodes of said first group and forms a first part of said major surface of said varistor part and said second low resistance part is in contact with one of said internal electrodes of said second group and forms a second part, which is different from said first part, of said major surface of said varistor part; said laminated varistor further comprising a first viahole connecting part defined in said varistor part for electrically connecting said internal electrodes of said first group with each other and a second viahole connecting part defined in said varistor part for electrically connecting said internal electrodes of said second group with each other.

11. A laminated varistor in accordance with claim 1, wherein said varistor part is formed of a first ceramic material which is selected to have a varistor function after firing and said low resistance parts are formed of a second ceramic material which is selected to be redesigned semiconductive by firing.

12. A laminated varistor in accordance with claim 11, wherein said second ceramic material for forming said low resistance parts contains a ceramic material which is identical in composition to said ceramic material forming said varistor part and further contains at least one element selected from the group consisting of Al, Ga, Gd, Zn and Y.

13. A laminated varistor in accordance with claim 11, wherein said low resistance parts are obtained by applying said second ceramic material raw to said varistor part, and then firing the same.

14. A laminated varistor in accordance with claim 13, wherein said varistor part and said low resistance parts are cofired and are integrated with each other.

15. A laminated varistor in accordance with claim 1, wherein said varistor part and said low resistance parts are comprised in a common ceramic body, said low resistance parts being parts of said ceramic body having partially lowered resistance.

16. A laminated varistor in accordance with claim 15, wherein said low resistance parts are formed by applying paste containing at least one element selected from the group consisting of Al, Ga, Gd, Zn and Y to parts of said ceramic body and performing heat treatment.

17. A laminated varistor in accordance with claim 16, wherein said low resistance parts contain a ceramic material which is identical in composition to the ceramic material forming said varistor part.

18. A laminated varistor in accordance with claim 17, wherein said low resistance parts and said varistor part contain ZnO.

19. A laminated varistor in accordance with claim 18, wherein said low resistance parts further contain Zn.

20. A laminated varistor in accordance with claim 16, wherein said varistor part and said low resistance parts contain different ceramic materials.

21. A laminated varistor in accordance with claim 20, wherein said low resistance parts contain $RuO_2$.

22. A laminated varistor in accordance with claim 15, wherein said low resistance parts are formed by applying a reducing solution to parts of said ceramic body.

23. A laminated varistor in accordance with claim 22, wherein said reducing solution is an organic borane compound solution.

24. A laminated varistor in accordance with claim 23, wherein said organic borane compound solution is a saturated solution of dimethylamine borane.

25. A laminated varistor in accordance with claim 15, wherein said varistor part is formed of a first ceramic material and said low resistance parts are obtained by applying a raw second ceramic material to said varistor part, and then firing the same.

26. A laminated varistor in accordance with claim 25, wherein said varistor part and said low resistance parts are cofired and integrated with each other.

27. A laminated varistor in accordance with claim 25, wherein said second ceramic material is applied to said varistor part in the form of a paste.

28. A laminated varistor in accordance with claim 25, wherein said second ceramic material is applied to said varistor part in the form of a ceramic green sheet.

29. A laminated varistor comprising;

a varistor part formed of a ceramic material which has a varistor function;

a plurality of internal electrodes arranged in parallel with each other, said internal electrodes being embedded within said varistor part, and having respective connection portions which are not physically exposed to the exterior of said varistor part;

at least two low resistance parts formed of the same ceramic material as in said varistor part, respective ones of said low resistance parts being electrically connected to said connection portions of said internal electrodes and protecting said internal electrodes from external moisture; and at least two external terminal means on said varistor part which are electrically connected respectively to said low resistance parts, said connection portions of said internal electrodes thereby being electrically exposed to the exterior through said low resistance parts.

* * * * *